US007300230B2

(12) United States Patent
Ong

(10) Patent No.: US 7,300,230 B2
(45) Date of Patent: Nov. 27, 2007

(54) PILE ANCHOR HEAD FOR AN UNDERPINNING PILE AND METHOD OF PRELOADING THE SAME

(76) Inventor: Chin Chai Ong, 32 Winterbell Court, Churchlands, Perth Western Australia 6018 (AU)

( * ) Notice: Subject to any disclaimer, the term of this patent is extended or adjusted under 35 U.S.C. 154(b) by 0 days.

(21) Appl. No.: 10/567,680

(22) PCT Filed: Aug. 10, 2004

(86) PCT No.: PCT/AU2004/001061

§ 371 (c)(1),
(2), (4) Date: Feb. 9, 2006

(87) PCT Pub. No.: WO2005/014940

PCT Pub. Date: Feb. 17, 2005

(65) Prior Publication Data

US 2006/0275085 A1 Dec. 7, 2006

(30) Foreign Application Priority Data

Aug. 11, 2003 (MY) ..... PI20032471

(51) Int. Cl.
*E02D 35/00* (2006.01)

(52) U.S. Cl. ..... 405/230; 405/255

(58) Field of Classification Search ..... 405/230, 405/231, 232, 244, 255
See application file for complete search history.

(56) References Cited

U.S. PATENT DOCUMENTS

| | | | | |
|---|---|---|---|---|
| 1,217,128 | A * | 2/1917 | White | 405/230 |
| 4,591,466 | A * | 5/1986 | Murray et al. | 405/230 |
| 4,765,777 | A * | 8/1988 | Gregory | 405/230 |
| 5,433,556 | A | 7/1995 | Freeman, III | |
| 6,193,442 | B1 | 2/2001 | May | |
| 6,814,524 | B1 * | 11/2004 | Peterson | 405/230 |
| 2001/0046415 | A1 | 11/2001 | Rupiper | |

FOREIGN PATENT DOCUMENTS

| | | | |
|---|---|---|---|
| CA | 2 235 890 | A | 10/1999 |

* cited by examiner

*Primary Examiner*—John Kreck
(74) *Attorney, Agent, or Firm*—Birch, Stewart, Kolasch & Birch, LLP

(57) ABSTRACT

There is disclosed an underpinning pile to provide an efficient, simple and sure method in driving and lifting the foundation and at the same time securing the direct transference of preload without further loss of preload from the building into the newly completed driven pile. A pile anchor head (11) is provided that receives a pile (12) and is provided with a lifting means (13). The pile anchor head (11) and lifting means (13) receive the building load and transfers it to the pile (12), which allows practically any kind of material and shape of pile (12) to be used.

13 Claims, 7 Drawing Sheets

PILE ANCHOR HEAD FOR AN UNDERPINNING PILE AND METHOD OF PRELOADING THE SAME

FIELD OF THE INVENTION

The present invention relates generally to an underpinning pile, especially to an underpinning pile having an improved pile anchor head for an improved pile efficiency and load capacity.

BACKGROUND OF THE INVENTION

Prior art teaches various methods for underpinning to strengthen settling foundation, via primarily two types of underpinning, namely the active and passive underpinning pile. Further, most of the methods are adapted for underpinning a wall foundation rather than a typical large pile cap which carries a concentrated load from the structural concrete frame of the building.

In passive underpinning pile, the new pile is inserted adjacent to the existing settling foundation and then is either bonded or connected to the pile cap or footing by means of a cantilever bracket, ties or enlarged footings. The settling foundation is allowed to settle further until the passive underpinning pile becomes loaded gradually with time. Such method has weakness as continuing settlement can occur over a long period especially if the pile is deep. Such use of passive underpinning piles is common as in U.S. Pat. No. 4,834,582 by Roger Bullivant which uses slanted cast in situ concrete piles and support ties beams. UK pat no:—2,047,303 by Leonard Flowerday has a vertical pile but a concrete cantilever corbel to carry the adjacent footing.

In an active underpinning pile, a certain amount of preloading is applied instantaneously upon the underpinning pile to support the weakened foundation, preventing it from any further settlement. An existing method in the prior art uses a system of complicated prefabricated steel brackets in conjunction with an arrangement of screws, rams or hydraulic jacks reacting against the existing weak foundations. In some cases, very cumbersome apparatus consisting of twin jacks or rams are used to react against the newly installed underpinning pile. A further weakness in some systems lies in the use of many complicated small parts, which may deteriorate and thus be unable to carry a large load if any key mechanism is damaged by wear or rust.

U.S. Pat. No. 5,120,163 by Holdeman has an inverted U-shaped coupler adapted to be temporarily secured to the foundation support to allow the hydraulic jack to react between the screw pile and footing. This method has many small screws and many other interconnecting parts, thus is adapted only to carry a smaller load due to the slant screw piles. This feature is also quite similar to U.S. Pat. No. 5,213,448 by Seider which uses a bracket for uplifting the footings.

US Pat no:—2002/0176749 A1 by Provost has an oversized anchor pile driven at a 15 degree slant at the foundation edge and installation of an anchor jack-plate having a collar and gusset attached thereto, slideable upon the screw anchor shaft. The eccentricity of the floating piers 16 reduces the capacity of the pile and is a source of weakness due to shearing in the jack plate and bending in the pile.

U.S. Pat. No. 3,796,055 by Mahony, uses a method and apparatus for lifting the foundation by gripping the sides of a pipe to drive it vertically against the adjacent foundation, in conjunction with jacks at a number of specified stations to lift the foundation. Portions of the buildings foundation are raised to further include the step of dispersing a body of hardenable cementations material outwardly of and below the lower end of the pipe to an enlarged hardened region of subterranean support resting on top of the pipe. This method is adapted for small load transfer as the enlarged cementations material can shear easily.

U.S. Pat. No. 5,433,556 by Freeman III, uses a pier driving assembly which includes a pier driving bracket which drives the pier pipes into the ground. This method is not suitable for underpinning inside the building due to the massive and deep excavation underneath the existing weakened foundations UK Pat no:—2,190,693 A by Frank Whittaker, uses an underpinning device for a wall structure comprising a bracket member 35 extending from a rectangular or tabular, hollow box-like member 34, locatable over the top of a previously driven support pile. In addition, an adjustable support means 37, 38 is located on the bracket 35. This system of cantilever demands that the pile is capable of overcoming the bending resistance from the bracket cantilever member and thus is anticipated for use with steel pipes or such that can offer corresponding bending resistance. Deep excavation is required underneath the footing to allow access for the placing of jacks or adjustable support means. Also wider and extensive excavations are required apart from the reduced capacity of the pile due to bending.

UK Pat no:—2,150,612 A by Arthur Joseph Steel, uses a system for underpinning a wall foundation comprising driving a plurality of tabular sleeves 13, by using hydraulic jacks, into which concrete is poured and allowed to harden. This is also similar in principle to UK Pat no:—2,024,283 A by John Patrick Jones, except that the pile has a central aperture running therethrough. Both methods involve waiting time for concrete curing and workability problems due to delays, as well as deep and wide excavations.

UK pat no:—2,255,990 by Roger A Bullivant uses a method of supporting the foundation by removing a short length of two or three courses of brick and supporting the building above the removed portion on a joist 14 with a pile connector 16 resting on a jack 28. The jack is stressed and the pile connector slides through the pipe pile and is fixed to it after stressing. This method uses the jack to react against the existing footing and thus only a certain reaction force is available from the old footing. The eccentricity of the pile connector 16 causes a large shearing and bending on the welds connecting the portion of C-channel to the pipe shaft 12. This method again is adapted for a low load as in a wall foundation.

Pending Malaysian patent no:—PI 20005487 filed by the present applicant discloses an underpinning pile system that works rather similarly to the present invention. However, PI 20005487 employs welding rather extensively which results in a slower process, inconsistent quality and costly operation. Apart from those problems, safety is another concern since welding parts may snap and cause serious hazards to workers. Therefore there arises a need for a design that eliminates or reduces the above problems. The design should be easy to handle, fast, efficient and safer than underpinning pile systems of the prior art.

SUMMARY OF THE INVENTION

Accordingly, an object of this present invention is to provide an efficient, simple and sure method in driving, lifting the foundation and at the same time securing the direct transference of preload from the building into the newly installed underpinning pile without further appreciable loss of preload.

Another object of the present invention is to provide a simple yet reliable pile anchor head such that the system can be assembled easily inside the excavation pit and preloaded with easy accesses to the critical welds instead of adjusting screws or placing jacks in a cumbersome and inaccessible work space underneath the footing.

The present invention teaches a method of assembly and method of installation of the pile head and apparatus for preloading and locking off reliably at the required load.

The present invention also provides a simple way of driving the underpinning pile into the ground inside the excavation hole independently, by way of using the underpinning pile system without using other additional machinery to install the pile.

The present invention also provides a simple way of pre-testing the capacity of the newly installed underpinning pile by directly jacking against the top of the pile to obtain a Load verses Settlement curve during preloading, thus making available an economical and versatile load test at the same time.

A significant aspect of the present invention is that the pile anchor head is adapted to receive the building load and transfer it to practically any kind of material and shape of pile without restricting to the common use of steel pipes in underpinning.

According to the broadest aspect of the present invention, these and other objectives are accomplished by:

An underpinning pile for lifting and strengthening a settling foundation comprising;

a pile;

said pile being provided with a pile anchor head;

characterised by said pile anchor head being provided with a lifting means for lifting said settling foundation.

In another aspect, an underpinning pile system for strengthening the existing settling foundation comprising of:

a pile;

a pile anchor head;

jacking means;

characterised by said pile anchor head being provided with a lifting means.

In another aspect, a method of using an underpinning pile system for lifting and underpinning a settling foundation comprising the steps of;

excavating a hole adjacent to said settling foundation;

placing a pile anchor head inside the excavation hole;

laying of a transfer beam such that said transfer beam sits on a flange of said pile anchor head;

installing a jacking means;

placing a pile through a tabular hollow section of said pile anchor head;

driving said pile to set; and locking off said pile to said pile anchor head.

It should be appreciated that the scope of the present invention need not be limited to the particular scope of the embodiments described above.

BRIEF DESCRIPTION OF THE DRAWINGS

Further understanding of the aspects of the present invention and their advantages will be discerned after studying the Detailed Description in conjunction with the accompanying drawings in which.

DETAILED DESCRIPTION OF THE INVENTIONS

Figure 1:
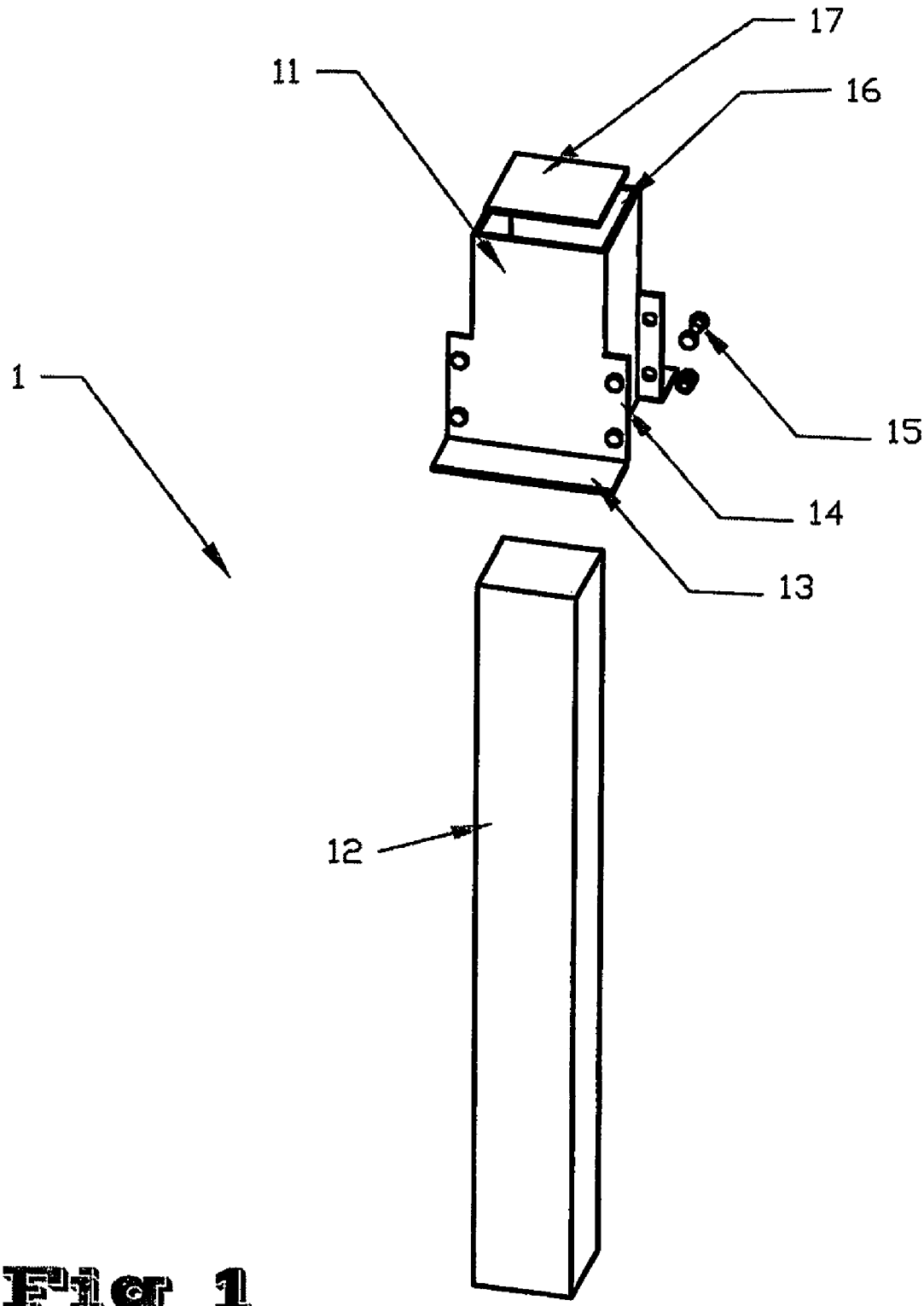
FIG. 1 shows an underpinning pile according to one embodiment of the present invention.

Referring to the drawings, like numerals indicate like components to facilitate explanation. In order to differentiate two separate entities belonging to like components, a suffix 'a' or 'b' is used to denote the first or second entity respectively.

Components of the Assembly

FIG. 1 shows the components of an underpinning pile (1) according to one embodiment of the present invention. In the broadest aspect of the present invention, the underpinning pile (1) comprises a pile (12), a pile anchor head (11) and a lifting means for lifting the settling foundation. The pile (12) can be any kind of material and shape such as timber, concrete, ex-rail piles or steel pipes.

The pile anchor head (11) of the present invention is designed to have a rectangular body with a tabular hollow section (16) for accommodating the pile (12). The body is made from two L-sections joined back to back by side plates. Thus, flanges (13) are provided on opposite flat parallel surfaces at sides of the pile anchor head (11) to act as a lifting means so a transfer beam (23) can rest on each of the flanges (13). One or more fastening pins (15) may also be optionally used as the lifting means and certain circumstances may render both the flanges (13) and the fastening pins (15) be used in combination. Further, the pile anchor head (11) is designed to have a locking means for locking off the pile anchor head (11) to the pile (12). One of the possible locking means is a pile anchor head plate (17) that has a size slightly smaller than the tabular hollow section (16) so that it can be inserted into the tabular hollow section (16) and later welded or fastened.

This design looks simple but it has a significant improvement over the prior art. The introduction of the lifting means eliminates welding for holding the transfer beam (23). This has an advantage over the prior art systems in terms of load capacity, efficiency and safety. Another significant inherent advantage of the present pile anchor head (11) is that shape and material of the pile (12) is not an issue because there is no welding required between the pile anchor head (11) and the pile (12). This means any shape such as round, rectangular, hexagonal and others, and any material such as timber, concrete, ex-rail piles or steel pipes can be used for the pile (12). The present invention permits a shallow excavation just sufficient to place the transfer beam (23) underneath the settling foundation, which is normally about 1 or 1.5 m deep. In some of the prior art, much deeper, wider and more extensive excavation is required.

Figure 2:
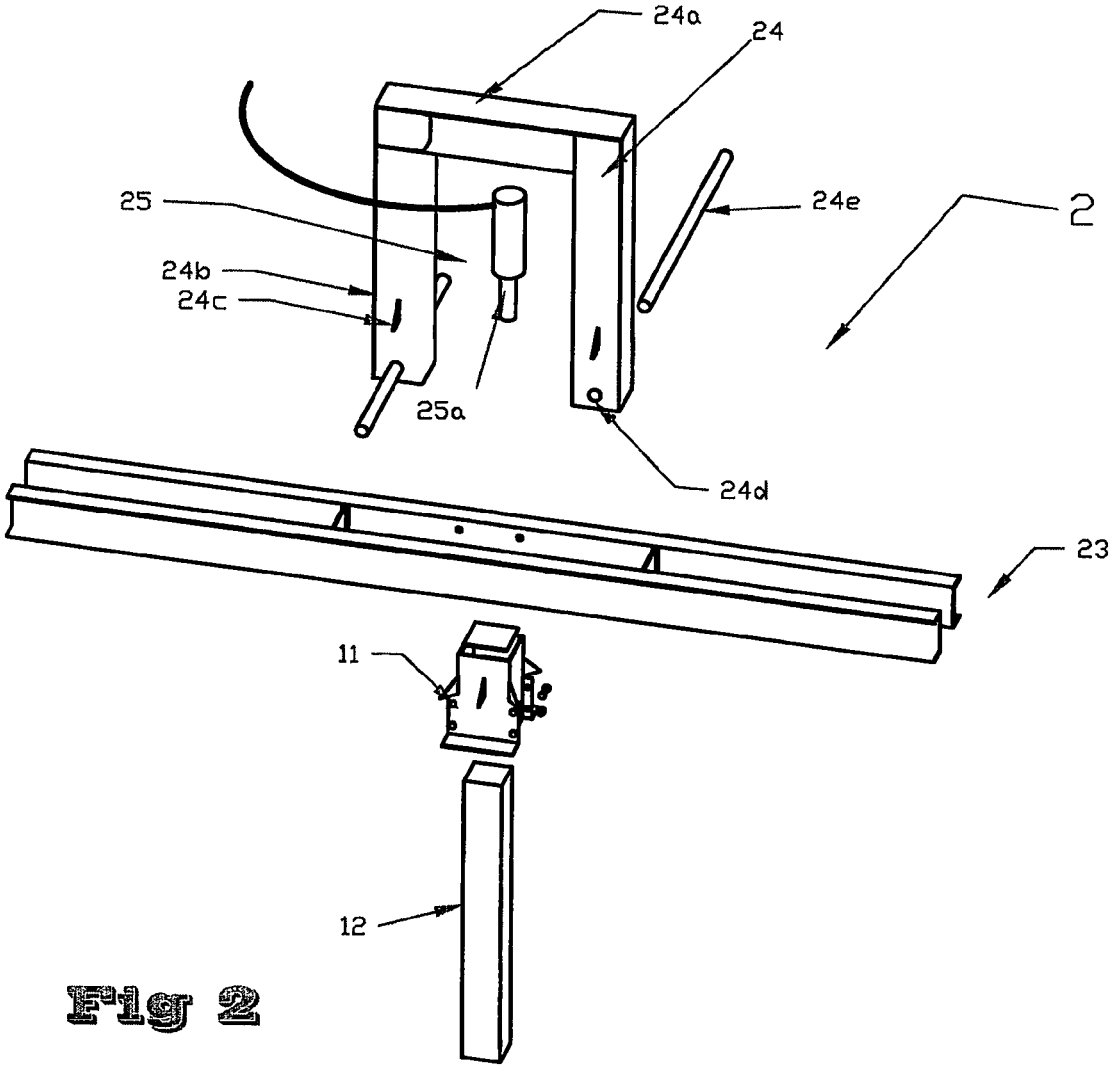
FIG. 2 shows an underpinning piling system and the auxiliary apparatus.

FIG. 2 shows an underpinning piling system (2) and the auxiliary apparatus. The underpinning pile system (2) of the present invention comprises the pile (12), the pile anchor head (11), a jacking means (25) and the transfer beam (23). As in the previous description, the pile anchor head (11) is provided with a lifting means.

In this embodiment, the jacking means (25) includes a hydraulic jack (25*a*) and a thrust block (24). In the present invention, a hydraulic jack is used, but any kind of jacking means available in the market may be used.

The thrust block (24) has been designed to have the shape of an inverted U. It has a horizontal member (24*a*) with vertical legs (24*b*) at each end of the horizontal member (24*a*). A through hole (24*d*) is provided at each distal end of the vertical legs (24*b*) for accommodating a respective locking pin (24*e*). Just above the through hole (24*d*) is welded a piece of plate to form a wedge (24*c*) on each leg (24*b*) of the thrust block (24) so that the thrust block (24) can rest on the transfer beam (23). Advantageously a pair of wedges are provided on each leg (24*b*).

With the present design, the thrust block (24) does not require rods to be welded to the top of the transfer beam (23). Two thick rods used as locking pins (24*e*) take the shearing load by supporting the base of the thrust block (24) against the transfer beam (23). The locking pins (24*d*) are easily assembled and disassembled thus improving the efficiency as well as increasing the safety and speed of assemblage for preloading operations.

Figure 3B:
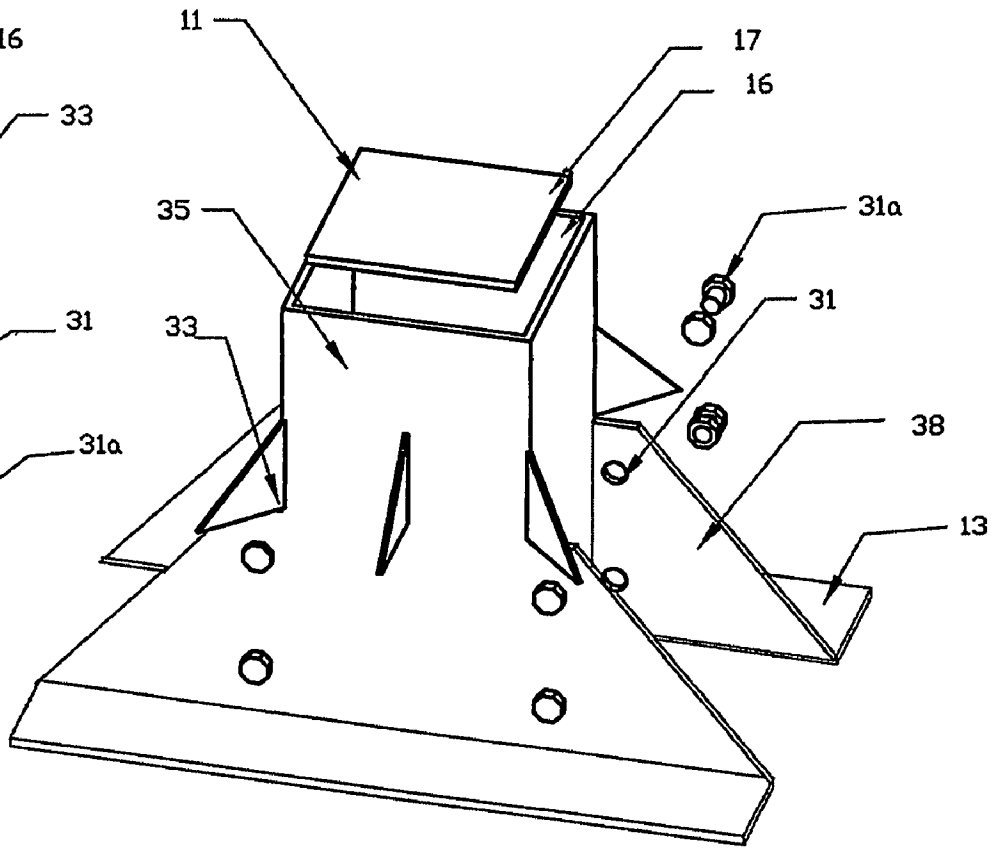
FIG. 3*b* shows another variation of a typical pile anchor head with a wider out splayed flange and web.
Figure 3A:
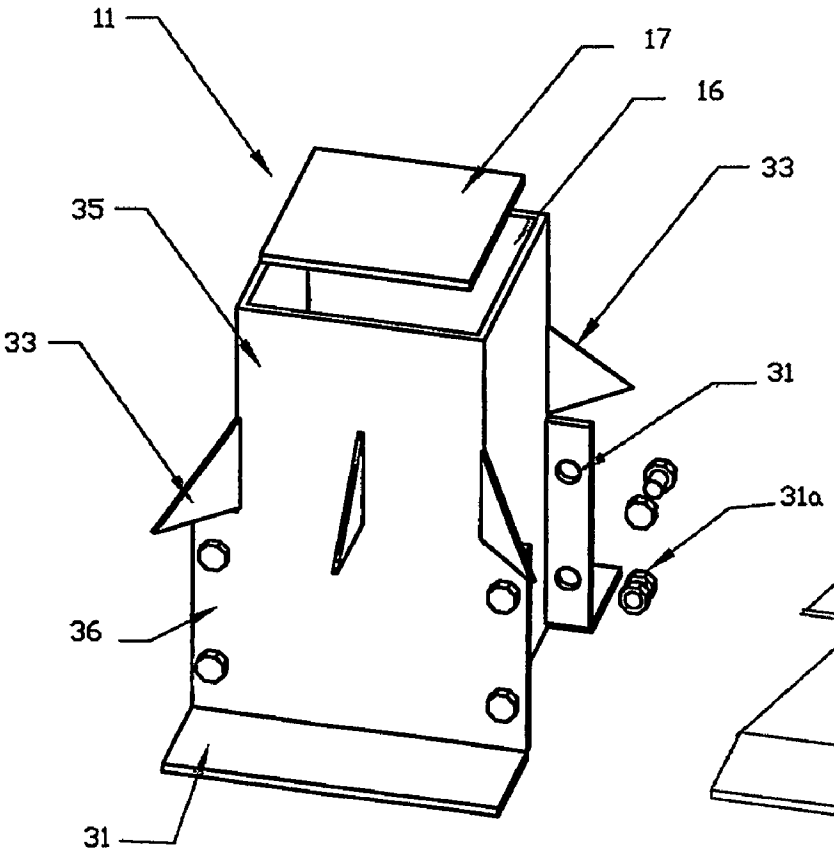
FIG. 3*a* shows a typical pile anchor head with optional attachments of triangular wedges and with nuts and bolts at corresponding positions to match a transfer beam.

FIGS. 3*a*, 3*b* show embodiments of the pile anchor head (11) that will be affixed to the top of the pile (12). The pile anchor head (11) as shown in FIG. 3*a* has a hollow tabular section (16) and extending flanges (13) on opposite sides at the base of the hollow tabular section (16) as previously described. On sides of the pile anchor head (11), a web (36) with two matching bolts (31*a*) and holes (31) are provided. The web (36) extends from the side of the hollow tabular section (16) and meets with the flange (13) to form an L-shaped ledge. In embodiment of FIG. 3*b*, the pile anchor head (11) is made with the extension of the flange out splayed with a matching triangular web (38) to meet the flanges (39) at the ends. In both pile anchor heads (11), the two flanges (13) carry almost the entire preload transferred from the hydraulic jack, although some will be carried through the bolts (31*a*). The shape of the hollow section of the pile anchor head (11) can be square, rectangular or any regular shape matching the pile (12) but preferably has two flat parallel surfaces for the flanges (13) and web formation (38). The internal dimensions of the hollow tabular section (16) of the pile anchor head (11) are such that it will fit snugly to accommodate the approximate cross-section of the pile (12). It is these two features that make the present pile anchor head (11) very versatile in use.

The pile anchor head (11) is also provided with a sufficiently thick pile anchor head plate (17) as shown in FIGS. 3*a* and 3*b*. The shape and dimension of the plate (17) fits with a small tolerance of around 2 mm inside the hollow tabular section (16) of the pile anchor head (11). The pile anchor head plate (17) shall be locked off by welding to the inner surface of the hollow tabular section (16) of the pile anchor head (11) upon reaching the required preload during the final process of installation which will be described further herein in the Installation Process. Triangular wedges (33) are additional optional features depending on the capacity of the preload, used to weld the pile anchor head (11) to a parallel C-channel transfer beam (23). It is also possible to omit the triangular wedges (33) and weld the top parallel sides (35) of the pile anchor head (11) to the parallel C-channel transfer beam.

Installation Process

Figure 4:
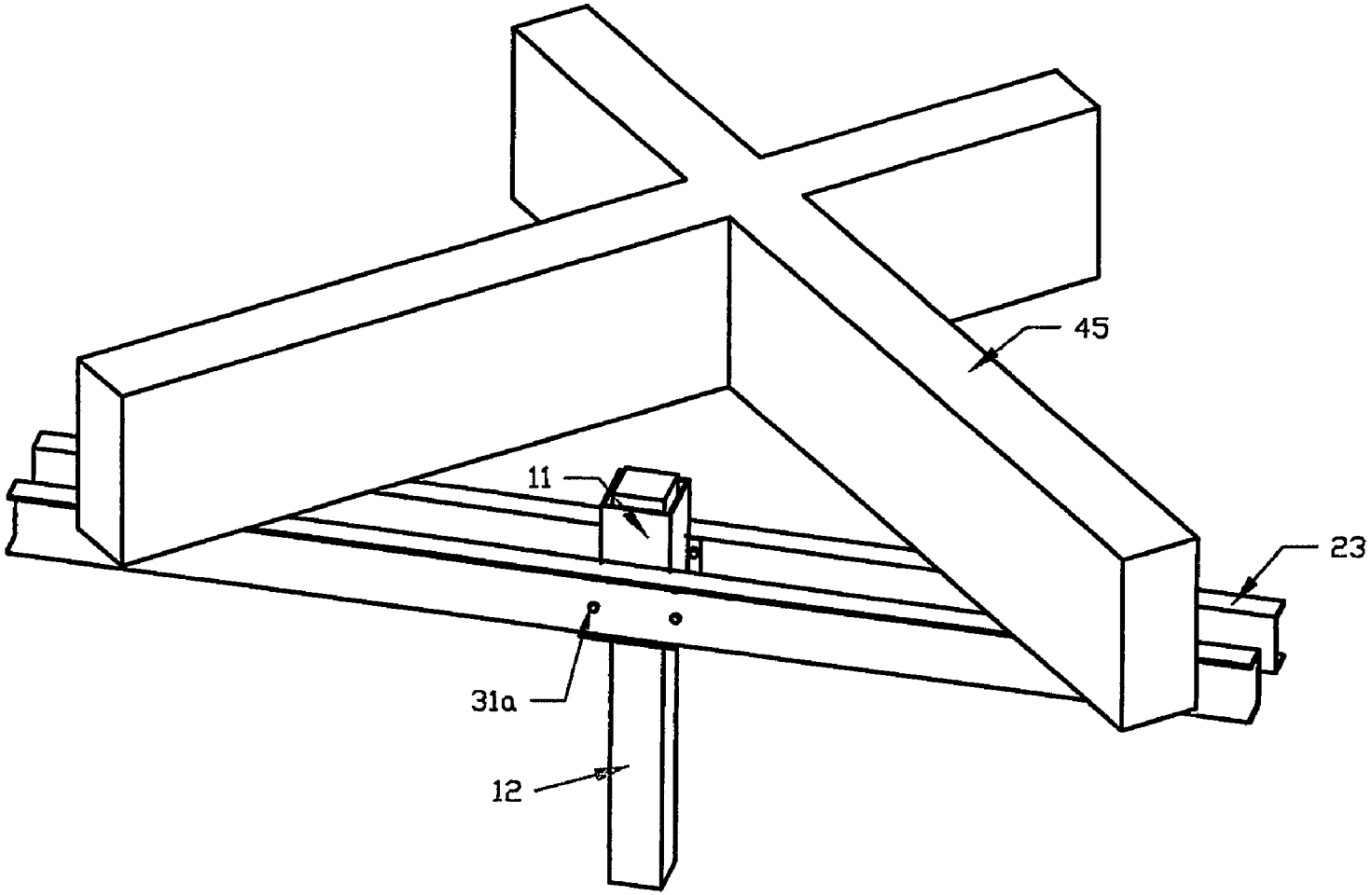
FIG. 4 shows installing two C-channels sides by side on each side of the pile anchor head.

FIG. 4 shows installation of two C-channels side by side on each side to act as the transfer beam (23) to transfer load from the settling foundation to the underpinning pile (12). A rather narrow and shallow pit measuring around 1 m wide×1 m long×1 m deep is excavated adjacent the settling foundation (4). The pile anchor head (11) is then laid on to the pit. Two C-channels are then inserted underneath the soffit of the foundation or ground beams (45) and eight bolts (not shown) are screwed in place to put the two C-channels securely bolted to the flanges (13) of the pile anchor head (11). The two C-channels are welded together to form the transfer beam (23) using two steel plates (not shown) at inner facing sides of the C-channels at an approximate equidistance from and on each side of the underpinning pile (12).

Figure 5:
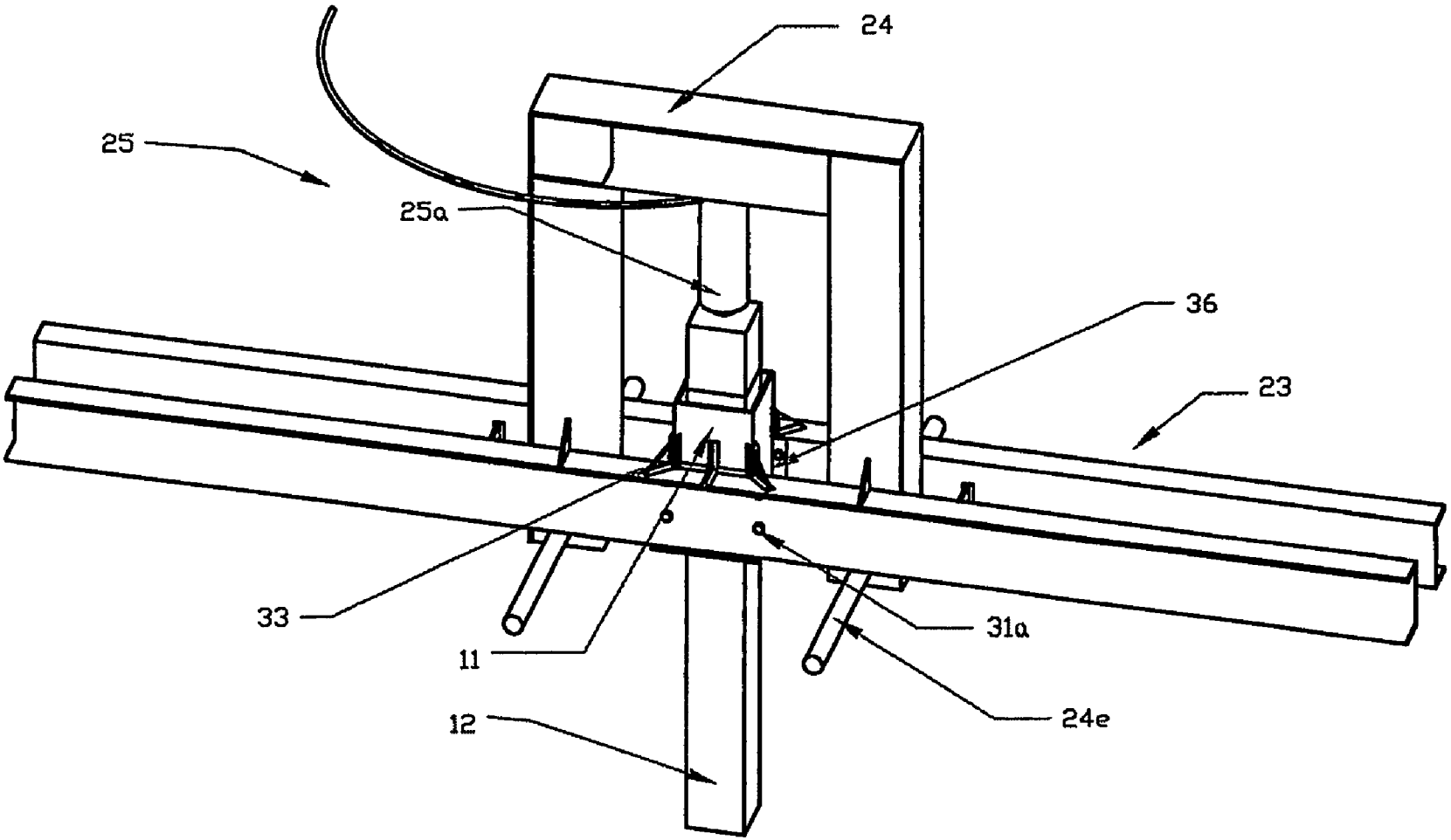
FIG. 5 shows the placing of a thrust block into the space between the gap of the parallel C-channels and inserting two large pins into the receiving holes at the ends of the thrust block just clearing beneath the soffit of the parallel C-channels.

FIG. 5 shows the placing of the thrust block (24) into the space between the gap of the parallel C-channels and inserting of the two locking pins (24*e*) into the receiving holes (24*d*) at the ends of the thrust block (24) just clearing beneath the soffit of the parallel C-channels. The two legs of the inverted U-shaped thrust block (24) are inserted into the middle space between the gap of the transfer beam (23). Wedges which are attached to the outer opposite faces of the two legs of the thrust block (24) are placed over the gap of the transfer beam (23) so that the base of the wedges rests squarely on the upper face of the transfer beam (23). The through holes (24*d*) in the legs are just exposed beneath the transfer beam (23) so that the large solid locking pins (24*e*) can be slid through the holes (24*d*). The pair of large locking pins (24*e*) will then bear against the base of the transfer beam (23) to which it is in contact during the jacking operation.

Figure 6:
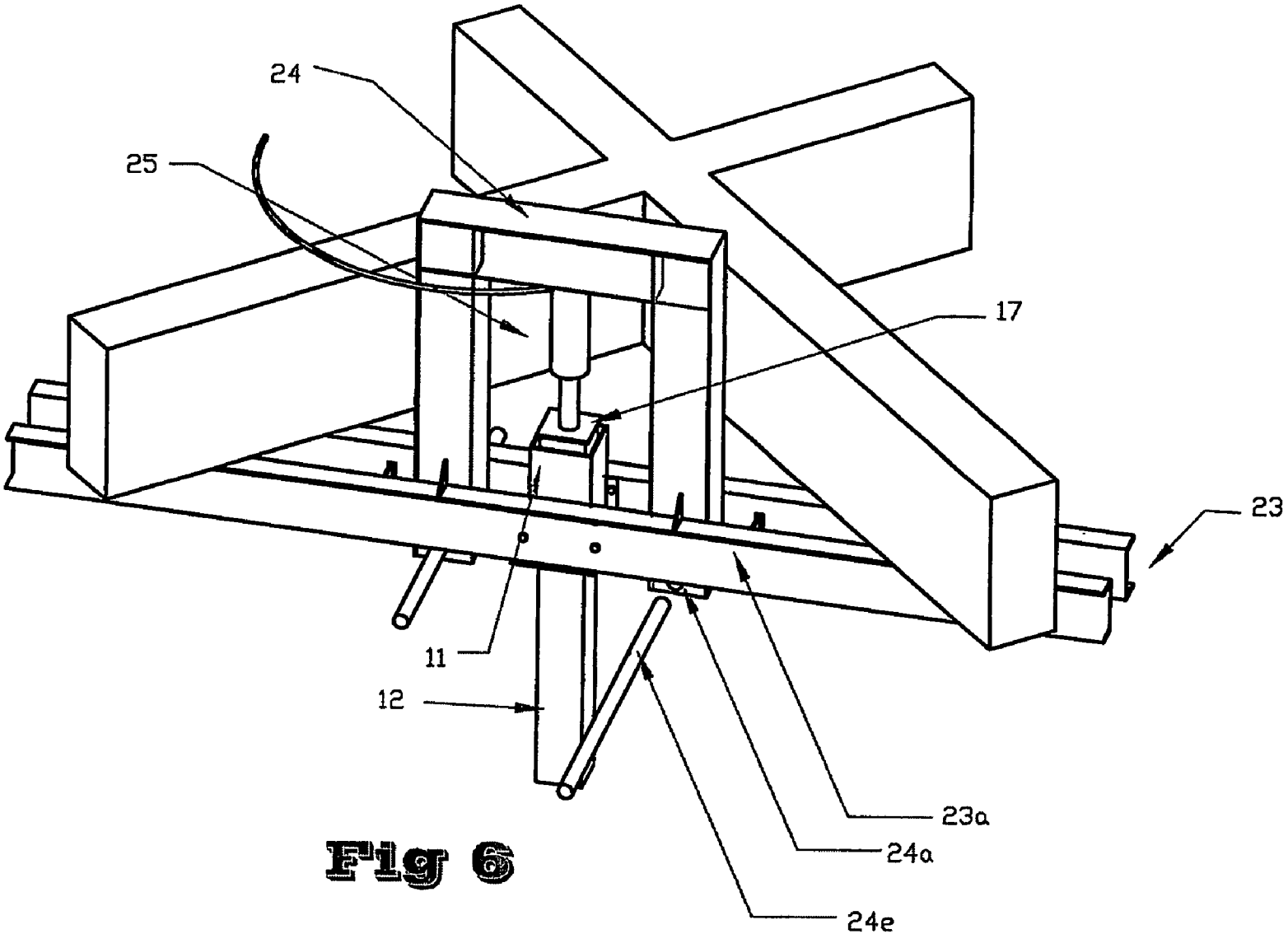
FIG. 6 shows the placing of a hydraulic jack over the top of the underpinning pile.

FIG. 6 shows the placing of the hydraulic jack (25) over the top of the underpinning pile (12). The hydraulic jack (25) is placed centrally underneath the horizontal member (24*a*) of the thrust block (24) such that when the jack (25) is activated the piston will extend to meet centrally at the pile anchor head plate (17). The pile anchor head plate (17) is positioned on top of the pile (12) and the hydraulic jack (65) is attached to the thrust block (24) such that the piston is just in contact with the pile anchor head plate (17) which is lying on top of the pile (12).

A load of up to about 100-120% of the working load of the foundation is applied to the pile (12) until set and is held in that position for a pre-determined time. This causes a direct vertical resultant force from the hydraulic jack (25) against the pile anchor head plate (17) on top of the pile (12). This will in turn pull the pair of locking pins (24*e*) upwards against the base of the transfer beam (23) thus resulting in lifting the foundation through the transfer beam (23) that is underneath the ground beam or foundation.

In the jacking operation, settlement of settling foundation is recorded at 15 minute intervals to check on the pile capacity. This means the pile (12) is capable of withholding the working load without appreciable inelastic settlement, usually at less than 12.5 mm. Upon confirmation of no further appreciable loss of preload by reading off the pressure gauge of the hydraulic jack (25), the pile anchor head plate (17) is then welded to the inside surfaces of the pile anchor head (11) in the process to effectively lock-off this preload. Further additional lines of welds on both sides of the pile anchor head (11) that is in contact with the transfer beam (23) can be made. In addition, four or six triangular wedges (not shown) can also be welded to the anchor pile head (11) and the top flanges of the transfer beam (23) to form a very rigid integral pile anchor head (11) with the transfer beam (23).

Figure 7:
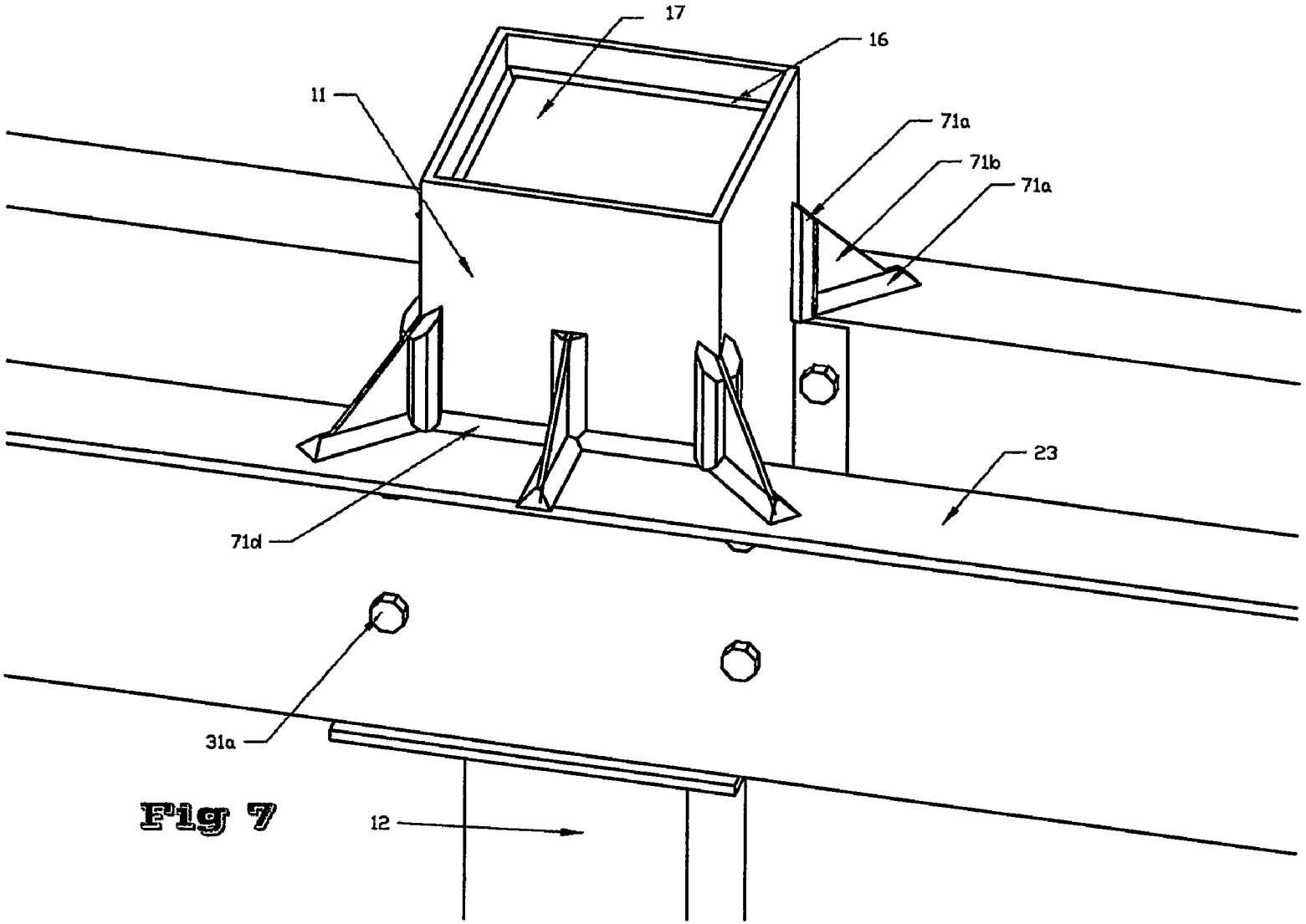
FIG. 7 shows a detailed close up of the completed pile anchor head preload.

FIG. 7 shows a detailed close up of the completed pile anchor head preloaded. Upon satisfaction of the set point, the pile anchor head (11) is locked off to the pile (12) by welding the pile anchor head plate (17) to the interior of the tabular hollow section (16). Further strengthening (71*a*) can be done by welding a plurality of wedges (71*b*) to the transfer beam (23) and to the pile anchor head (11). Still additional welding (71*d*) can be done between the pile anchor head (11) and transfer beam (23). Upon completion of the welds, the pile (12) is deemed to be fully operational and the two locking pins (not shown) are removed from the thrust block (24). This will leave the preloaded pile (12) welded securely to the pile anchor head plate (17) and the transfer beam (23) supporting the building foundation beams. The efficiency of this weld enables very large loads up to 200 tons to be carried through each anchor pile head compared to the existing prior art system of adjusting brackets and locking off the screws, which carries typically from about 1-10 tons. While the preferred embodiment of the present invention and their advantages have been disclosed in the above Detailed Description, the invention is not limited thereto but only by the scope of the appended claims.

The invention claimed is:

1. A method for installing an underpinning pile system for lifting and underpinning a settling foundation characterised by comprising the steps of:

excavating a hole adjacent to the foundation;

placing a transfer beam having an opening for receiving the upper end of a pile in the excavated hole, the transfer beam being arranged to engage with the foundation on at least two points, one either side of said opening;

placing a pile anchor head having a hollow section for receiving the upper end of the pile in the opening in the transfer beam such that the pile anchor head engages with the transfer beam adjacent the opening;

placing a pile through the hollow section in the pile anchor head;

engaging a jacking means with the transfer beam and the upper end of the pile; and driving the pile downwardly relative to the stationary transfer beam by operation of the jacking means.

2. A method for installing an underpinning pile system in accordance with claim 1, characterised by including the step of securing any further movement of the pile relative to the pile anchor head once the pile is driven into position and loaded with a locking means to engage the pile with the pile anchor head.

3. A method for installing an underpinning pile system in accordance with claim 2, characterised by including the steps of driving the pile downwardly until the upper end of the pile is within the hollow section of the pile anchor head and inserting an anchor plate into the hollow section to bear on the top of the pile and welding the anchor plate to internal surfaces of the hollow section of the pile anchor head.

4. A method for installing an underpinning pile system in accordance with claim 1, characterised in that engaging the jacking means with the transfer beam and the pile comprises the steps of:

inserting legs of an inverted U-shaped thrust block downwardly through the opening in the transfer beam such that the legs are positioned on opposite sides of the pile;

engaging ends of the legs with the transfer beam; and inserting a jack between the upper end of the pile and a lower side of a horizontal member of the inverted U-shaped thrust block.

5. A method for installing an underpinning pile system in accordance with claim 4, characterised in that locking pins are inserted through holes provided in the ends of the legs of the inverted U-shaped thrust block when the ends of the legs are located below the transfer beam, such that the locking pins engage with a lower surface of the transfer beam and thereby resist upward movement of the inverted U-shaped thrust block relative to the transfer beam.

6. A method for installing an underpinning pile system in accordance with claim 5 characterised in that the step of driving the pile downwardly relative to the transfer beam comprises the step of extending the jack to force the pile downwardly relative to the thrust block.

7. A method for installing an underpinning pile system in accordance with claim 1 including the step of securing the pile anchor head to the transfer beam once the pile is driven into position and secured to the pile anchor head.

8. A method for installing an underpinning pile system in accordance with claim 7 characterised by placing a plurality of wedges such that the wedges engage against the pile anchor head and the transfer beam, and welding the wedges to the transfer beam and the pile anchor head.

9. A method in accordance with claim 1, the pile anchor head characterised in that the cross section of the hollow member is complementary to the shape of the anchor plate such that the anchor plate is secured within the hollow member of said anchor head against the upper end of the pile by welding to inner surfaces of the hollow member of said anchor head.

10. A method in accordance with claim 1, characterised in that the portion of the pile anchor head that engages with the transfer beam comprises a plurality of flanges that engage with an underside of the transfer beam.

11. A method in accordance with claim 1, characterised in that the jacking means comprises an inverted U-shaped thrust block and a jack, the inverted U-shaped thrust block arranged such that ends of parallel legs of the thrust block extend downwardly through the opening in the transfer beam on either side of the pile and engage with the transfer beam, and the jack engages between the upper horizontal member of the inverted U-shaped thrust block and the upper end of the pile to force the pile downwardly relative to the thrust block.

12. A method in accordance with claim 11, characterised in that the ends of the legs of the inverted U-shaped thrust block are provided with holes to receive locking pins such that when the holes are positioned below the transfer beam and the locking pins are inserted through the holes, the locking pins engage with the lower surface of the transfer beam to resist upward movement of the U-shaped thrust block relative to the transfer beam.

13. A method in accordance with claim 12, characterised in that the legs of the U-shaped thrust block include outwardly extending wedges, the wedges engaging with an upper surface of the transfer beam when the U-shaped thrust block is inserted downwardly through the opening in the transfer beam.

* * * * *